United States Patent [19]

Tibbetts

[11] Patent Number: 4,991,599

[45] Date of Patent: Feb. 12, 1991

[54] FIBERLESS TOBACCO PRODUCT FOR SMOKING AND CHEWING

[76] Inventor: Hubert M. Tibbetts, 137 Pecksland Rd., Greenwich, Conn. 06831

[21] Appl. No.: 453,629

[22] Filed: Dec. 20, 1989

[51] Int. Cl.[5] ..... A24B 15/24

[52] U.S. Cl. ..... 131/297; 131/352; 131/353; 131/359; 131/369; 131/370

[58] Field of Search ..... 131/297, 298, 369, 359, 131/353, 370, 372, 352

[56] References Cited

U.S. PATENT DOCUMENTS

| | | | |
|---|---|---|---|
| 90,301 | 5/1869 | Posada | 131/297 |
| 179,323 | 6/1987 | Krackowizer | 131/298 |
| 2,478,473 | 8/1949 | Eskew | 131/297 |
| 3,316,919 | 5/1967 | Green et al. | 131/297 |

*Primary Examiner*—V. Millin

*Attorney, Agent, or Firm*—Parmalee, Bollinger & Bramblett

[57] ABSTRACT

A dried, concentrated fiberless aqueous extract of cured tobacco leaves suitable for smoking or chewing and a process for producing same.

3 Claims, No Drawings

FIBERLESS TOBACCO PRODUCT FOR SMOKING AND CHEWING

FIELD OF THE INVENTION

This invention relates to a fiberless tobacco product for smoking in a cigarette or pipe or for chewing.

BACKGROUND OF THE INVENTION

It has long been recognized by many that smoking of tobacco, particularly cigarettes, has a detrimental effect on the health of smokers. Among the health hazards attributed to smoking of cigarettes are lung cancer, emphysema and various bronchial ailments as detailed in the U.S. Surgeon General's report and numerous subsequent reports. Since the Surgeon General's report, much research and development has been directed toward reduction of nicotine and tar forming components in tobacco in an attempt to reduce the health hazard of cigarette smoking. However, such resulting products have not been found to eliminate or significantly reduce those health hazards to persons continuing to smoke cigarettes.

It is therefore desirable that a tobacco product be available for smoking in cigarettes or pipes which has a reduced or substantially eliminated health hazard. It is a further object of this invention to provide such a tobacco product which is relatively easy to produce. It is believed that such an improved and safer tobacco product could be provided by a tobacco product that is essentially completely fiberless.

SUMMARY OF THE INVENTION

An improved tobacco product is provided by a dried, fiberless concentrated aqueous extract of tobacco. The dried fiberless aqueous extract may be used as smoking tobacco in pipes or cigarettes or, if desired, used as a chewing tobacco product.

DETAILED DESCRIPTION OF THE INVENTION

The smokable or chewable fiberless tobacco product of this invention is produced by obtaining a fiberless aqueous extract of tobacco. Any suitable means for obtaining an aqueous extract of tobacco may be employed. For example, any suitable means for passing boiling water or water vapor through tobacco to obtain the aqueous extract may be employed, such as by percolation or steam distillation or vacuum evaporation.

The tobacco employed in the process may be any suitable tobacco leaf product. Preferably, the tobacco leaf is shredded or comminuted to minute particles in order to speed up and enhance the process of obtaining the fiberless aqueous extract thereof.

Most preferably, boiling water is permitted to percolate through minutely shredded, cured tobacco leaves and the aqueous extract is then collected in a suitable container or vessel and boiled don to a concentrated syrup extract or solid or solidified in an oven at an elevated temperature. After the concentrated fiberless tobacco extract has been solidified, it is subject to crushing to produce a dried fiberless tobacco product suitable for smoking or chewing.

If desired, the concentrated aqueous tobacco extract could be mixed with a suitable smokable or chewable fiberless bulking material, such as for example fiberless cornmeal, prior to drying and solidification of the aqueous extract.

EXAMPLE OF THE INVENTION

Into a suitable sized percolator 18.43 grams of shredded, cured tobacco leaf was placed in a percolator basket and three successive aliquots of boiling water, 473 ml, 236.5 ml and 236.5 ml, respectively, were passed through the shredded tobacco leaf. The three aqueous tobacco leaf extracts were then combined and placed in a pan on a heated stove and the water boiled off for approximately thirty minutes until a concentrated syrupy extract was produced. The concentrated extract was placed in a foil-lined container and dried in a drying oven at 205° C. for about twenty minutes until a dried solid product was obtained.

The dried fiberless tobacco extract was removed from the oven cooled to room temperature, then crushed into suitably sized tobacco particles, placed in the bowl of a pipe, lit and smoked. A pleasant and pleasing smoke was obtained with a clean taste and aroma of tobacco but having no fibers present to produce health hazards.

The crushed, solid, fiberless tobacco extract can be rolled into cigarette paper and smoked as cigarettes or chewed as chewing tobacco, if desired.

Also, if desired, the concentrated syrupy extract could be mixed with any suitable fiberless, smokable bulking agent, before drying the extract into a solid.

With the foregoing description of the invention, those skilled in the art will appreciate that modifications may be made to the invention without departing from the spirit thereof. Therefore, it is not intended that the scope of the invention be limited to the specific embodiments illustrated and described.

I claim:

1. A process for producing a smokable or chewable tobacco product having a tobacco taste and aroma but essentially free of fibers comprising:

providing cured tobacco leaf, passing boiling water or water vapor through said tobacco leaf, collecting the boiling water or water vapor to produce an aqueous, fiberless extract of said tobacco, concentrating and drying said aqueous extract to produce a solid fiberless tobacco extract, and crushing said solid fiberless extract into smokable or chewable particles of a fiberless tobacco extract.

2. The process of claim 1 wherein the tobacco leaf is shredded tobacco leaf.

3. A smokable or chewable fiberless tobacco product made by the process of claim 1.

* * * * *